United States Patent [19]

Kalnes et al.

[11] Patent Number: 5,028,313

[45] Date of Patent: Jul. 2, 1991

[54] PROCESS FOR TREATING A TEMPERATURE-SENSITIVE HYDROCARBONACEOUS STREAM CONTAINING A NON-DISTILLABLE COMPONENT TO PRODUCE A DISTILLABLE HYDROCARBONACEOUS PRODUCT

[75] Inventors: Tom N. Kalnes, La Grange; Robert B. James, Jr., Northbrook, both of Ill.

[73] Assignee: UOP, Des Plaines, Ill.

[21] Appl. No.: 354,063

[22] Filed: May 19, 1989

Related U.S. Application Data

[63] Continuation-in-part of Ser. No. 76,804, Jul. 23, 1987, abandoned.

[51] Int. Cl.[5] ..... C10M 175/00

[52] U.S. Cl. ..... 208/185; 208/184; 208/186; 208/356; 208/362

[58] Field of Search ..... 208/362, 356, 184, 185, 208/186

[56] References Cited

U.S. PATENT DOCUMENTS

| | | | |
|---|---|---|---|
| 2,992,285 | 11/1976 | Hutchings | 208/208 R |
| 4,127,393 | 11/1978 | Timmins et al. | 48/213 |
| 4,481,101 | 11/1984 | Yan | 208/50 |
| 4,882,037 | 11/1989 | Kalnes et al. | 208/185 |

*Primary Examiner*—Curtis R. Davis

*Assistant Examiner*—William Diemler

*Attorney, Agent, or Firm*—Thomas K. McBride; John G. Tolomei; John G. Cutts, Jr.

[57] ABSTRACT

A process for treating a hydrocarbonaceous feed stream containing a non-distillable component to produce a distillable hydrocarbonaceous product and a heavy product comprising the non-distillable component while minimizing thermal degradation of the hydrocarbonaceous feed stream which process comprises the steps of: (a) contacting the hydrocarbonaceous feed stream with a hot first hydrogen-rich gaseous stream having a temperature greater than the hydrocarbonaceous feed stream in a flash zone at flash conditions without indirect heat exchange thereby increasing the temperature of the hydrocarbonaceous feed stream and vaporizing at least a portion thereof to provide a hydrocarbonaceous vapor stream comprising hydrogen and a heavy product comprising the non-distillable component; (b) removing the hydrocarbonaceous vapor stream comprising hydrogen from the flash zone without contacting the vapor stream with hydrocarbonaceous liquid; (c) condensing at least a portion of the hydrocarbonaceous vapor stream comprising hydrogen to provide a second hydrogen-rich gaseous stream and a liquid stream comprising distillable hydrocarbonaceous compounds; and (d) recovering a distillable hydrocarbonaceous product from the liquid stream comprising distillable hydrocarbonaceous compounds.

9 Claims, 1 Drawing Sheet

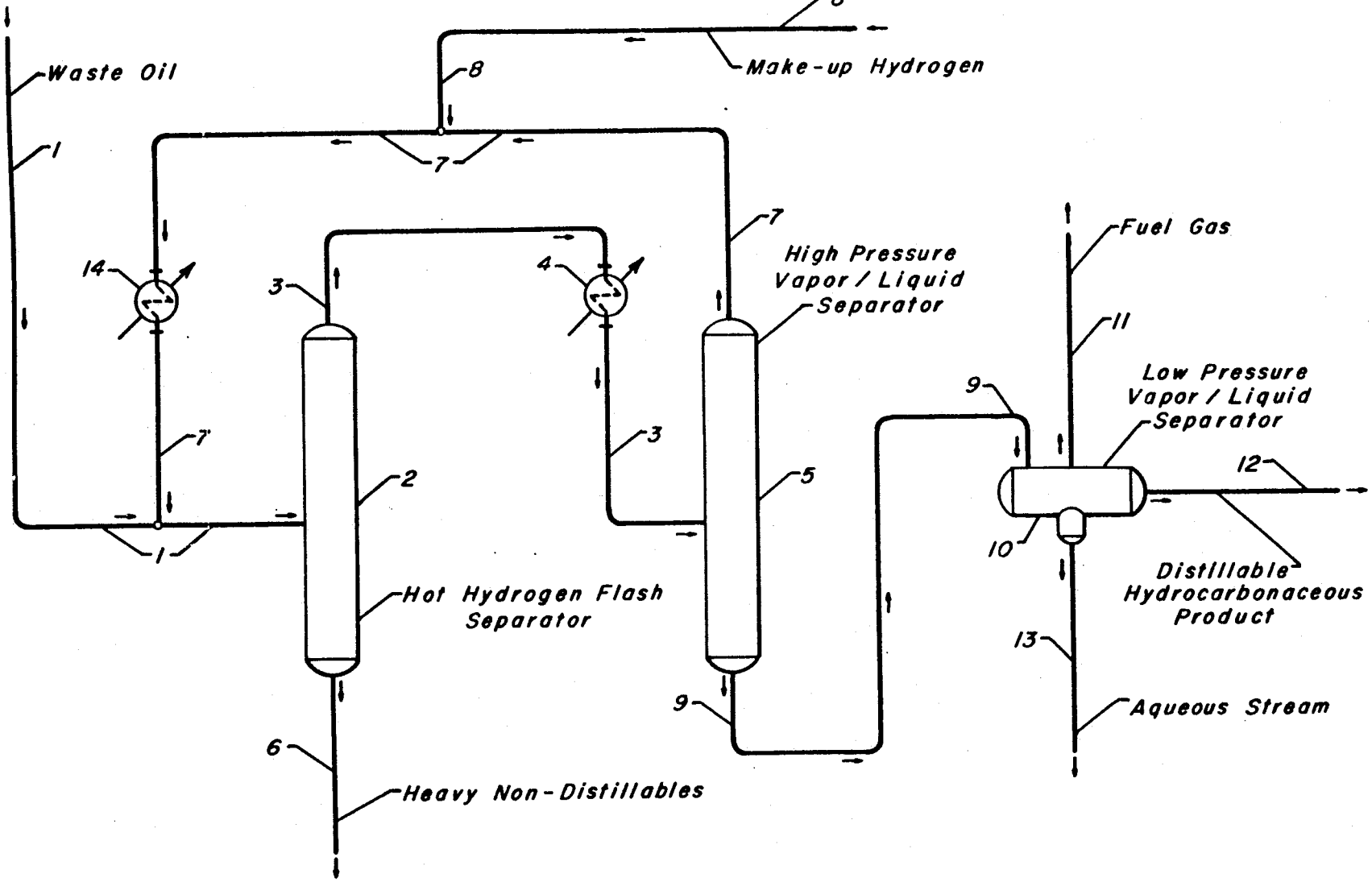
Fuel Gas
11
Low Pressure Vapor / Liquid Separator
12
Distillable Hydrocarbonaceous Product
Aqueous Stream
13
10
9
High Pressure Vapor / Liquid Separator
5
Make-up Hydrogen
8
7
3
4
Hot Hydrogen Flash Separator
2
Heavy Non-Distillables
6
Waste Oil
1
14
7'

PROCESS FOR TREATING A TEMPERATURE-SENSITIVE HYDROCARBONACEOUS STREAM CONTAINING A NON-DISTILLABLE COMPONENT TO PRODUCE A DISTILLABLE HYDROCARBONACEOUS PRODUCT

CROSS-REFERENCE TO RELATED APPLICATION

This application is a continuation-in-part of application Ser. No. 076,804 filed July 23, 1987, now abandoned all the teachings of which are hereby incorporated by reference.

BACKGROUND OF THE INVENTION

The field of art to which this invention pertains is the production of a distillable hydrocarbonaceous product from a hydrocarbonaceous feed stream containing a non-distillable component while minimizing thermal degradation of the hydrocarbonaceous feed stream. More specifically, the invention relates to a process for treating a hydrocarbonaceous feed stream containing a non-distillable component to produce a distillable hydrocarbonaceous product and a heavy product comprising the non-distillable component while minimizing thermal degradation of the hydrocarbonaceous feed stream which process comprises the steps of: (a) contacting the hydrocarbonaceous feed stream with a hot first hydrogen-rich gaseous stream having a temperature greater than the hydrocarbonaceous feed stream in a flash zone at flash conditions without indirect heat exchange thereby increasing the temperature of the hydrocarbonaceous feed stream and vaporizing at least a portion thereof to provide a hydrocarbonaceous vapor stream comprising hydrogen and a heavy product comprising the non-distillable component; (b) removing the hydrocarbonaceous vapor stream comprising hydrogen from the flash zone without contacting the vapor stream with hydrocarbonaceous liquid; (c) condensing at least a portion of the hydrocarbonaceous vapor stream comprising hydrogen to provide a second hydrogen-rich gaseous stream and a liquid stream comprising distillable hydrocarbonaceous compounds; and (d) recovering a distillable hydrocarbonaceous product from the liquid stream comprising distillable hydrocarbonaceous compounds.

INFORMATION DISCLOSURE

In U.S. Pat. No. 3,992,285 (Hutchings), a process is disclosed for the desulfurization of a hydrocarbonaceous black oil containing sulfur and asphaltic material which comprises preheating the oil by indirect heat exchange to a temperature not in excess of about 550° F., commingling the preheated oil with a steam-containing gas to raise the temperature of the oil to a desulfurization temperature of about 600° F. to about 800° F. and contacting the thus heated oil at hydrocarbon conversion conditions with a desulfurization catalyst.

In U.S. Pat. No. 4,127,393 (Timmins et al), a process is disclosed for the vaporization of non-distillate oils under "non-decomposing" conditions in the presence of a hydrogen-containing gas heated to a temperature above the feed stream. The '393 patent also teaches that the feed stream be preheated before introduction into the vessel which presents an opportunity for the decomposition of the feed stream before the process is initiated. In accordance with the '393 patent, a portion of the hot hydrogen-containing gas is routed through a tube or pipe which transfers heat to a pool of liquid feed comprising distillable components thereby presenting another opportunity for the decomposition (coking) of hydrocarbonaceous components on the hot surface of the heat exchange tubes. The presence of a pool of hydrocarbonaceous components will almost certainly ensure that the stated desire to minimize any feed stream decomposition will not be achieved. The '393 patent also teaches that a gas, vapor and liquid mixture is contacted with a solid surface or surfaces which are exemplified as a series of trays which contain pools of liquid hydrocarbonaceous components and which pools provide additional residence time for the thermal decomposition of the hydrocarbonaceous components.

In U.S. Pat. No. 4,481,101 (Yan), a process is disclosed for demetallation and desulfurization of resid by visbreaking (thermal cracking) an admixture of resid, added particulate solids, and steam and/or hydrogen, and then subjecting the visbroken mixture to high temperature settling and separating to provide a first vapor product, a liquid product, and a recycled underflow solids stream. The process further comprises coking the recovered liquid product.

BRIEF SUMMARY OF THE INVENTION

The present invention provides an improved process for the production of a distillable hydrocarbonaceous product from a temperature-sensitive hydrocarbonaceous feed stream containing a non-distillable component by means of contacting the hydrocarbonaceous feed stream with a hot hydrogen-rich gaseous stream to increase the temperature of the feed stream to vaporize at least a portion of the distillable hydrocarbonaceous compounds thereby producing a distillable hydrocarbonaceous product while minimizing thermal degradation of the hydrocarbonaceous feed stream. Important elements of the improved process are the relatively short time that the feed stream is maintained at elevated temperature, the avoidance of heating the feed stream via indirect heat exchange, the separation and recovery of the non-distillable component and the inhibition of coking reactions provided by the presence of hydrogen.

One embodiment of the invention may be characterized as a process for treating a hydrocarbonaceous feed stream containing a non-distillable component to produce a distillable hydrocarbonaceous product and a heavy product comprising the non-distillable component while minimizing thermal degradation of the hydrocarbonaceous feed stream which process comprises the steps of: (a) contacting the hydrocarbonaceous feed stream with a hot first hydrogen-rich gaseous stream having a temperature greater than the hydrocarbonaceous feed stream in a flash zone at flash conditions without indirect heat exchange thereby increasing the temperature of the hydrocarbonaceous feed stream and vaporizing at least a portion thereof to provide a hydrocarbonaceous vapor stream comprising hydrogen and a heavy product comprising the non-distillable component; (b) removing the hydrocarbonaceous vapor stream comprising hydrogen from the flash zone without contacting the vapor stream with hydrocarbonaceous liquid; (c) condensing at least a portion of the hydrocarbonaceous vapor stream comprising hydrogen to provide a second hydrogen-rich gaseous stream and a liquid stream comprising distillable hydrocarbonaceous compounds; and (d) recovering a distillable hydrocarbonaceous product from the liquid stream comprising distillable hydrocarbonaceous compounds.

Another embodiment of the invention may be characterized as a process for treating a hydrocarbonaceous feed stream containing a non-distillable component to produce a distillable hydrocarbonaceous product and a heavy product comprising the non-distillable component while minimizing thermal degradation of the hydrocarbonaceous feed stream which process comprises the steps of: (a) contacting the hydrocarbonaceous feed stream with a hot first hydrogen-rich gaseous stream having a temperature greater than the hydrocarbonaceous feed stream in a flash zone at flash conditions without indirect heat exchange thereby increasing the temperature of the hydrocarbonaceous feed stream and vaporizing at least a portion thereof to provide a first hydrocarbonaceous vapor stream comprising hydrogen and a heavy product comprising the non-distillable component; (b) removing the hydrocarbonaceous vapor stream comprising hydrogen from the flash zone without contacting the vapor stream with hydrocarbonaceous liquid; (c) condensing at least a portion of the first hydrocarbonaceous vapor stream comprising hydrogen to provide a second hydrogen-rich gaseous stream and a first liquid stream comprising distillable hydrocarbonaceous compounds and dissolved hydrogen; and (d) separating the first liquid stream comprising distillable hydrocarbonaceous compounds and dissolved hydrogen to provide a third hydrogen-rich gaseous stream and a normally liquid distillable hydrocarbonaceous product.

Other embodiments of the present invention encompass further details such as preferred feedstocks and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

There is a steadily increasing demand for technology which is capable of treating a temperature-sensitive hydrocarbonaceous stream containing a non-distillable component to produce a distillable hydrocarbonaceous product and a heavy non-distillable product while minimizing thermal degradation or conversion of the hydrocarbonaceous feed stream. Such treatment has always been in demand for the preparation and production of various hydrocarbonaceous products but with the increased environmental emphasis for the treatment and recycle of waste hydrocarbonaceous products there is an increased need for improved processes to separate heavy non-distillable components from a distillable hydrocarbonaceous product. For example, during the disposal or recycle of potentially environmentally harmful hydrocarbonaceous waste streams, an important step in the total solution to the problem is the pretreatment or conditioning of a hydrocarbonaceous stream which facilitates the ultimate resolution to provide product streams which may subsequently be handled in an environmentally acceptable manner. Therefore, those skilled in the art have sought to find feasible techniques to remove heavy non-distillable components from a temperature-sensitive hydrocarbonaceous feed stream to provide a distillable hydrocarbonaceous product. Previous techniques which have been employed include filtration, vacuum wiped film evaporation, solvent extraction, centrifugation, and vacuum distillation.

The present invention provides an improved process for the removal of heavy non-distillable components from a temperature-sensitive hydrocarbonaceous feed stream. A wide variety of temperature-sensitive hydrocarbonaceous streams are to be candidates for feed streams in accordance with the process of the present invention. Examples of hydrocarbonaceous feed streams which are suitable for treatment by the process of the present invention are dielectric fluids, hydraulic fluids, heat transfer fluids, used lubricating oil, used cutting oils, used solvents, still bottoms from solvent recycle operations, coal tars, atmospheric residuum, oils contaminated with polychlorinated biphenyls (PCB), pesticide wastes or other hydrocarbonaceous industrial waste. Many of these hydrocarbonaceous streams may contain non-distillable components which include, for example, organometallic compounds, inorganic metallic compounds, finely divided particulate matter and non-distillable hydrocarbonaceous compounds. Herein, halogenated hydrocarbons and organometallic compounds are considered to be toxic hydrocarbonaceous compounds. The present invention is particularly advantageous when the non-distillable components comprise sub-micron particulate matter and the conventional techniques of filtration or centrifugation tend to be highly ineffective.

Once the temperature-sensitive hydrocarbonaceous feed stream is separated into a distillable hydrocarbonaceous product and a heavy non-distillable product, each of these products may be utilized as recovered or may be subsequently treated or processed by any known technique or process. If the feed stream contains metallic compounds such as those that contain metals such as zinc, copper, iron, barium, phosphorus, magnesium, aluminum, lead, mercury, cadmium, cobalt, arsenic, vanadium, chromium, and nickel, these compounds will be isolated in the relatively small volume of recovered non-distillable product which may then be treated for metals recovery or otherwise disposed of as desired. In the event that the feed stream contains distillable hydrocarbonaceous compounds which include sulfur, oxygen, nitrogen, metal or halogen components, the resulting recovered distillable hydrocarbonaceous product may be further processed to remove or convert any such components as desired or required.

In accordance with the subject invention, a temperature-sensitive hydrocarbonaceous stream containing a non-distillable component is contacted with a hot hydrogen-rich gaseous stream having a temperature greater than the hydrocarbonaceous stream in a flash zone at flash conditions thereby increasing the temperature of the hydrocarbonaceous stream and vaporizing at least a portion thereof to provide a hydrocarbonaceous vapor stream comprising hydrogen and a heavy non-distillable product while minimizing thermal degradation of the hydrocarbonaceous feed stream. The hydrogen-rich gaseous stream preferably comprises more than about 80 mole % hydrogen and more preferably more than about 90 mole % hydrogen. The hydrogen-rich gaseous stream is multifunctional and serves as 1) a heat source used to directly heat the hydrocarbonaceous feed stream to preclude the coke formation that could otherwise occur when using an indirect heating apparatus such as a heater or heat-exchanger, 2) a diluent to reduce the partial pressure of the hydrocarbonaceous compounds, 3) a possible reactant to minimize the formation of hydrocarbonaceous polymers, and 4) a stripping medium. In accordance with the subject invention, the temperature-sensitive hydrocarbonaceous feed stream is preferably maintained at a temperature less than about 482° F. (250° C.) before being introduced into the flash zone in order to prevent or minimize the thermal degradation of the feed stream. Depending upon the characteristics and composition of the hydrocarbonaceous feed stream, the hot hydrogen-rich gaseous stream is introduced into the flash zone at a temperature greater than the hydrocarbonaceous feed stream and preferably at a temperature from about 200° F. (93° C.) to about 1200° F. (649° C.).

During the contacting, the flash zone is preferably maintained at flash conditions which include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on the hydrocarbonaceous feed stream and an average residence time of the hydrogen-containing, hydrocarbonaceous vapor stream in the flash zone from about 0.1 seconds to about 50 seconds. A more preferred average residence time of the hydrogen-containing, hydrocarbonaceous vapor stream in the flash zone is from about 1 second to about 10 seconds.

The resulting heavy non-distillable portion of the feed stream is removed from the bottom of the flash zone as required to yield a heavy non-distillable product. The heavy non-distillable product may contain a relatively small amount of distillable components but since essentially all of non-distillable components contained in the hydrocarbonaceous feed stream are recovered in this product stream, the term "heavy non-distillable product" is nevertheless used for the convenient description of this product stream. The heavy non-distillable product preferably contains an atmospheric distillable component of less than about 10 weight percent and more preferably less than about 5 weight percent. Under certain circumstances with a feed stream not having an appreciable amount of liquid non-distillable components, it is contemplated that an additional liquid may be utilized to flush the heavy non-distillables from the flash zone. An example of this situation is when the hydrocarbonaceous feed stream comprises a very high percentage of distillable hydrocarbonaceous compounds and relatively small quantities of finely divided particulate matter (solid) and essentially no liquid non-distillable component for use as a carrier for the solids. Such a flush liquid may, for example, be a diesel cut boiling in the range from about 500° F. (260° C.) to about 700° F. (371° C.), a high boiling range vacuum gas oil having a boiling range from about 700° F. (371° C.) to about 1000° F. (538° C.) or a vacuum tower bottoms stream boiling at a temperature greater than about 1000° F. (538° C.). The selection of a flush liquid depends upon the composition of the hydrocarbonaceous feed stream and the prevailing flash conditions in the flash separator, and the volume of the flush liquid is preferably limited to that required for removal of the heavy non-distillable component.

The resulting hydrocarbonaceous vapor stream comprising hydrogen is removed from the flash zone and at least a portion thereof is condensed to provide a second hydrogen-rich gaseous stream and a liquid stream comprising distillable hydrocarbonaceous compounds.

In the drawing, one embodiment of the subject invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art of hydrocarbon processing techniques. With reference now to the drawing, a waste oil feed stream having a non-distillable component is introduced into the process via conduit 1 and is contacted with a hot gaseous hydrogen-rich recycle stream which is provided via conduit 7 and hereinafter described. The waste oil and the hydrogen-rich recycle stream are intimately contacted in hot hydrogen flash separator 2. A hydrocarbonaceous vapor stream comprising hydrogen is removed from hot hydrogen flash separator 2 via conduit 3, cooled in heat-exchanger 4 and introduced via conduit 3 into high pressure vapor/liquid separator 5. A heavy non-distillable stream is removed from the bottom of hot hydrogen flash separator 2 via conduit 6 and recovered. A hydrogen-rich gaseous stream is removed from separator 5 via conduit 7, heated to a suitable temperature in heat-exchanger 14 and utilized to contact the waste oil feed stream as hereinabove described. Since hydrogen is lost from the process by means of a portion of the hydrogen being dissolved in the exiting liquid hydrocarbon, it is necessary to supplement the lost hydrogen with make-up hydrogen from some suitable external source, i.e., a catalytic reforming unit or a hydrogen plant. Make-up hydrogen may be introduced into the system at any convenient and suitable point, and is introduced in the drawing via conduit 8. A liquid hydrocarbonaceous stream containing hydrogen in solution is removed from high pressure vapor/liquid separator 5 via conduit 9 and is introduced into low pressure vapor/liquid separator 10. A gaseous stream comprising hydrogen and any normally gaseous hydrocarbons present is removed from low pressure vapor/liquid separator 10 via conduit 11 and recovered. A normally liquid distillable hydrocarbonaceous product is removed from low pressure vapor/liquid separator 10 via conduit 12 and recovered. In the event that the waste oil feed stream contains water, this water is recovered from low pressure vapor/liquid separator 10 via conduit 13.

The following example is presented for the purpose of further illustrating the process of the present invention, and to indicate the benefits afforded by the utilization thereof in producing a distillable hydrocarbonaceous product while minimizing thermal degradation of the temperature-sensitive hydrocarbonaceous feed stream containing a non-distillable component. The hot hydrogen was introduced into the hot hydrogen flash separation zone at a rate of 31 mass units per hour.

EXAMPLE

A waste lube oil having the characteristics presented in Table 1 and contaminated with 1020 ppm by weight of polychlorinated biphenyl (PCB), as Aroclor, was charged at a rate of 100 mass units per hour to a hot hydrogen flash separation zone. The hot hydrogen was introduced into the hot hydrogen flash separation zone at a rate of 31 mass units per hour.

TABLE 1

| WASTE LUBE OIL FEEDSTOCK PROPERTIES (5375-45) | |
|---|---|
| Specific Gravity @ 60° F. (15° C.) | .8827 |

TABLE 1-continued

| WASTE LUBE OIL FEEDSTOCK PROPERTIES (5375-45) | | |
|---|---|---|
| Vacuum Distillation Boiling Range, (ASTM D-1160) | °F. | (°C.) |
| IBP | 338 | (170) |
| 10% | 516 | (269) |
| 20% | 628 | (331) |
| 30% | 690 | (367) |
| 40% | 730 | (388) |
| 50% | 750 | (399) |
| 60% | 800 | (421) |
| 70% | 831 | (444) |
| 80% | 882 | (474) |
| % Over | 80 | |
| % Bottoms | 20 | |
| Sulfur, weight percent | | 0.5 |
| Polychlorinated Biphenyl Concentration, wppm | | 1020 |
| Lead, wppm | | 863 |
| Zinc, wppm | | 416 |
| Cadmium, wppm | | 1 |
| Copper, wppm | | 21 |
| Chromium, wppm | | 5 |

The waste lube oil was preheated to a temperature of <482° F. (<250° C.) before introduction into the flash separation zone which temperature precluded any significant detectable thermal degradation. The waste lube oil was intimately contacted in the flash separation zone with a hot hydrogen-rich gaseous stream having a temperature upon introduction into the flash separation zone of >748° F. (>398° C.). In addition, the hot hydrogen flash separator zone was operated at conditions which included a temperature of 748° F. (398° C.), a pressure of 500 psig (3447 kPa gauge), a hydrogen circulation rate of 18000 SCFB (3034 normal $m^3/m^3$) and an average residence time of the vapor stream of 5 seconds. A hydrocarbonaceous vapor stream comprising hydrogen was recovered from the flash separation zone, cooled to 77° F. (25° C.) and introduced into a high pressure separator. An overhead gas stream in an amount of 31 mass units per hour and having the characteristics presented in Table 2 was recovered from the high pressure separator and a hereinafter described low pressure separator.

TABLE 2

| ANALYSIS OF OVERHEAD GAS STREAM | |
|---|---|
| Hydrogen, volume percent | 100 |

A liquid stream was removed from the high pressure separator and introduced into a low pressure separator to provide a portion of the overhead gas stream described hereinabove and a liquid bottoms stream in the amount of 88 mass units per hour having the characteristics presented in Table 3.

TABLE 3

| ANALYSIS OF LOW PRESSURE SEPARATOR BOTTOMS STREAM | | |
|---|---|---|
| Specific Gravity @ 60° F. (15° C.) | 0.866 | |
| Vacuum Distillation Boiling Range, (ASTM D-1160) | °F. | (°C.) |
| IBP | 225 | (107) |
| 10% | 433 | (223) |
| 20% | 538 | (280) |
| 30% | 633 | (334) |
| 40% | 702 | (372) |
| 50% | 741 | (394) |
| 60% | 770 | (410) |
| 70% | 801 | (427) |
| 80% | 837 | (447) |

TABLE 3-continued

| ANALYSIS OF LOW PRESSURE SEPARATOR BOTTOMS STREAM | | |
|---|---|---|
| 0% | 896 | (479) |
| 95% | 943 | (506) |
| EP | 982 | (527) |
| % Over | 97 | |
| % Bottoms | 3 | |
| Sulfur, weight percent | | 0.31 |
| Polychlorinated Biphenyl Concentration, wppm | | 1143 |
| Lead, wppm | | 3.7 |
| Zinc, wppm | | 1.5 |
| Cadmium, wppm | | <0.04 |
| Copper, wppm | | 0.1 |
| Chromium, wppm | | 0.6 |

A non-distillable liquid stream was recovered from the bottom of the flash separation zone in an amount of 12 mass units per hour and having the characteristics presented in Table 4.

TABLE 4

| ANALYSIS OF NON-DISTILLABLE STREAM | |
|---|---|
| Specific Gravity @ 60° F. (15° C.) | 0.9 |
| Polychlorinated Biphenyl Concentration, wppm | 110 |

In summary, this example demonstrated that a waste lube oil having a non-distillable component and containing 1020 wppm of polychlorinated biphenyl and 1306 wppm heavy metals i.e., lead, zinc, cadmium, copper and chromium was separated into a distillable hydrocarbonaceous stream containing 98.6 weight percent of the polychlorinated biphenyl contained in the waste lube oil and a heavy stream comprising essentially all of the non-distillable component of the waste lube oil including 99.5 weight percent of the heavy metals. The analysis of the overhead gas stream showed that the temperature-sensitive waste lube oil did not experience undesirable thermal cracking with the accompanying formation of normally gaseous hydrocarbonaceous compounds.

The foregoing description, drawing and example clearly illustrate the advantages encompassed by the process of the present invention and the benefits to be afforded with the use thereof.

We claim:

1. A process for treating a hydrocarbonaceous feed stream containing a non-distillable component to produce a distillable hydrocarbonaceous product and a heavy product comprising said non-distillable component while minimizing thermal degradation of said hydrocarbonaceous feed stream which process comprises the steps of:

(a) contacting said hydrocarbonaceous feed stream with a hot first hydrogen-rich gaseous stream having a temperature greater than said hydrocarbonaceous feed stream in a flash zone at flash conditions without indirect heat exchange thereby increasing the temperature of said hydrocarbonaceous feed stream and vaporizing at least a portion thereof to provide a first hydrocarbonaceous vapor stream comprising hydrogen and a heavy product comprising said non-distillable component;

(b) removing said hydrocarbonaceous vapor stream comprising hydrogen from said flash zone without contacting said vapor stream with hydrocarbonaceous liquid;

(c) condensing at least a portion of said first hydrocarbonaceous vapor stream comprising hydrogen to provide a second hydrogen-rich gaseous stream and a first liquid stream comprising distillable hydrocarbonaceous compounds and dissolved hydrogen; and (d) separating said first liquid stream comprising distillable hydrocarbonaceous compounds and dissolved hydrogen to provide a third hydrogen-rich gaseous stream and a normally liquid distillable hydrocarbonaceous product.

2. The process of claim 1 wherein said hydrocarbonaceous feed stream comprises dielectric fluids, hydraulic fluids, heat transfer fluids, used lubricating oil, used cutting oils, used solvents, still bottoms from solvent recycle operations, coal tars, atmospheric residuum, PCB-contaminated oils, pesticide wastes or other hydrocarbonaceous industrial waste.

3. The process of claim 1 wherein said non-distillable component is selected from the group consisting of organometallic compounds, inorganic metallic compounds, finely divided particulate matter and non-distillable hydrocarbonaceous compounds.

4. The process of claim 1 wherein said hydrocarbonaceous feed stream is introduced into said flash zone at a temperature less than about 482° F. (250° C.).

5. The process of claim 1 wherein the temperature of said hot first hydrogen-rich stream is from about 200° F. (93° C.) to about 1200° F. (649° C.).

6. The process of claim 1 wherein said flash conditions include a temperature from about 150° F. (65° C.) to about 860° F. (460° C.), a pressure from about atmospheric to about 2000 psig (13788 kPa gauge), a hydrogen circulation rate of about 1000 SCFB (168 normal $m^3/m^3$) to about 30,000 SCFB (5056 normal $m^3/m^3$) based on said hydrocarbonaceous feed stream, and an average residence time of said hydrocarbonaceous vapor stream comprising hydrogen in said flash zone from about 0.1 seconds to about 50 seconds.

7. The process of claim 1 wherein at least a portion of said second hydrogen-rich gaseous stream recovered in step (c) is recycled to step (a).

8. The process of claim 1 wherein said hydrocarbonaceous feed stream containing a non-distillable component comprises toxic hydrocarbonaceous compounds.

9. The process of claim 1 wherein said toxic hydrocarbonaceous compounds are selected from the group consisting of halogenated hydrocarbons and organometallic compounds.

* * * * *